US005880697A

United States Patent [19]

McCarrick et al.

[11] Patent Number: 5,880,697

[45] Date of Patent: Mar. 9, 1999

[54] LOW-PROFILE MULTI-BAND ANTENNA

[75] Inventors: Charles D. McCarrick, Plymouth; John M. Seavey, Cohasset, both of Mass.; Thomas S. Seay, Solana Beach, Calif.; Ronald K. Manherz; Wayne T. Cottle, both of San Diego, Calif.

[73] Assignee: Torrey Science Corporation, San Diego, Calif.

[21] Appl. No.: 719,768

[22] Filed: Sep. 25, 1996

[51] Int. Cl.[6] ..... H01Q 7/00; H01Q 1/24

[52] U.S. Cl. ..... 343/742; 343/702; 343/744; 343/846; 343/855

[58] Field of Search ..... 343/702, 742, 343/743, 744, 846, 867, 855; H01Q 1/24, 5/00, 7/00

[56] References Cited

U.S. PATENT DOCUMENTS 4,862,181 8/1989 Ponce De Leon et al. ..... 343/866

OTHER PUBLICATIONS

Burberry, "VHF and UHF Antennas" Peter Peregnus, Ltd. UK, 1992, p. 161.

Johnson "Antenna Engineering Handbook," 3rd ed, Georgia Institute of Technology, 1993, pp. 27–21, 37–18/19.

*Primary Examiner*—Michael C. Wimer

*Attorney, Agent, or Firm*—Edward W. Callan

[57] ABSTRACT

A multi-band low-profile antenna includes a conductive ground-plane element; a first radiator element mounted on the ground-plane element to define a first vertical loop; a second radiator element mounted on the ground-plane element to define a second vertical loop; and a coupling element mounted on the ground-plane element to define a vertical coupling loop, with one end portion of the coupling element being connected to a feed terminal. In at least one embodiment, the first radiator element and the second radiator element are of such dimensions and are so disposed as to be parasitically coupled to each other, to cause the first radiator element to resonate at a first predetermined VHF frequency and to cause the second radiator element to resonate at a second predetermined VHF frequency. The coupling element is of such dimensions and is so disposed in relation to the first radiator element and the second radiator element as to cause a signal at the first predetermined VHF frequency to be inductively coupled between the first radiator element and the feed terminal and to cause a signal at the second predetermined VHF frequency to be inductively coupled between the second radiator element and the feed terminal. The antenna further includes a third radiator element of such dimensions and is so disposed as to resonate at a predetermined UHF frequency; and the coupling element is of such dimensions and is so disposed as to cause a signal at the predetermined UHF frequency to be inductively coupled between the third radiator element and the feed terminal. A compartment in the ground-plane element encloses circuit components of a communication device connected to the feed terminal.

33 Claims, 2 Drawing Sheets

LOW-PROFILE MULTI-BAND ANTENNA

BACKGROUND OF THE INVENTION

The present invention generally pertains to antennas and is particularly directed to low-profile antennas for use in the VHF and/or UHF bands.

One type of low-profile VHF antenna is a marker-beacon antenna, which is mounted to the conductive skin of an aircraft on the underside of the aircraft fuselage. The conductive skin of the aircraft functions as a ground-plane element defining a ground plane. The antenna includes an elongated radiator element disposed in relation to the ground plane to define a first vertical loop when the ground plane is horizontally disposed, with a substantial segment of the radiator element being at least somewhat parallel to the ground plane, with one end of the radiator element being connected to the ground-plane element and with another end of the radiator element being capacitively coupled to the ground-plane element, with the radiator element being of such dimensions as to resonate at a fixed predetermined frequency, but without any significant bandwidth; and an elongated coupling element disposed in relation to the ground-plane element to define a vertical coupling loop when the ground plane is horizontally disposed, with a substantial segment of the coupling element being substantially parallel to the ground plane, with one end portion of the coupling element being connected to the ground-plane element and with another end portion of the coupling element being connected to a feed terminal. The coupling element is of such dimensions and is so disposed in relation to the radiator element as to cause a signal at the predetermined frequency to be inductively coupled between the radiator element and the feed terminal. A marker-beacon antenna is described by R. A. Burberry, "VHF and UHF Antennas", Peter Peregnus, Ltd., UK, 1992, p. 161.

SUMMARY OF THE INVENTION

The present invention provides a multi-band antenna, comprising a ground-plane element defining a ground plane; an elongated ribbon-shaped first radiator element having opposing broad surfaces and disposed on the ground-plane element with the broad surfaces of a substantial segment of the first radiator element being at least somewhat parallel to the ground plane to define a first vertical loop when the ground plane is horizontally disposed; a second radiator element; an elongated ribbon-shaped coupling element having opposing broad surfaces and disposed on the ground-plane element with the broad surfaces of a substantial segment of the coupling element being at least somewhat parallel to the ground plane to define a vertical coupling loop when the ground plane is horizontally disposed, and with a portion of the coupling element being connected to a feed terminal; wherein the first radiator element, the second radiator element and the coupling element are of such dimensions and are so disposed in relation to each other as to cause the first radiator element to resonate at a first predetermined frequency, to cause the second radiator element to resonate at a second predetermined frequency, to cause a signal at the first predetermined frequency to be inductively coupled between the first radiator element and the feed terminal and to cause a signal at the second predetermined frequency to be inductively coupled between the second radiator element and the feed terminal.

In some preferred embodiments, the second radiator element is elongated and ribbon-shaped with opposing broad surfaces and disposed on the ground-plane element with the broad surfaces of a substantial segment of the second radiator element being at least somewhat parallel to the ground plane to define a second vertical loop when the ground plane is horizontally disposed, and the antenna further comprises a third radiator element of such dimensions and so disposed in relation to the coupling element as to resonate at a third predetermined frequency and to cause a signal at the third predetermined frequency to be inductively coupled between the third radiator element and the feed terminal. Such embodiments may be used for transmitting and receiving signals in the VHF band with the first and second radiator elements respectively and for transmitting and/or receiving signals in the UHF band with the third radiator element.

Additional features of the present invention arc described with reference to the detailed description of the preferred embodiments.

DETAILED DESCRIPTION

Figure 1:
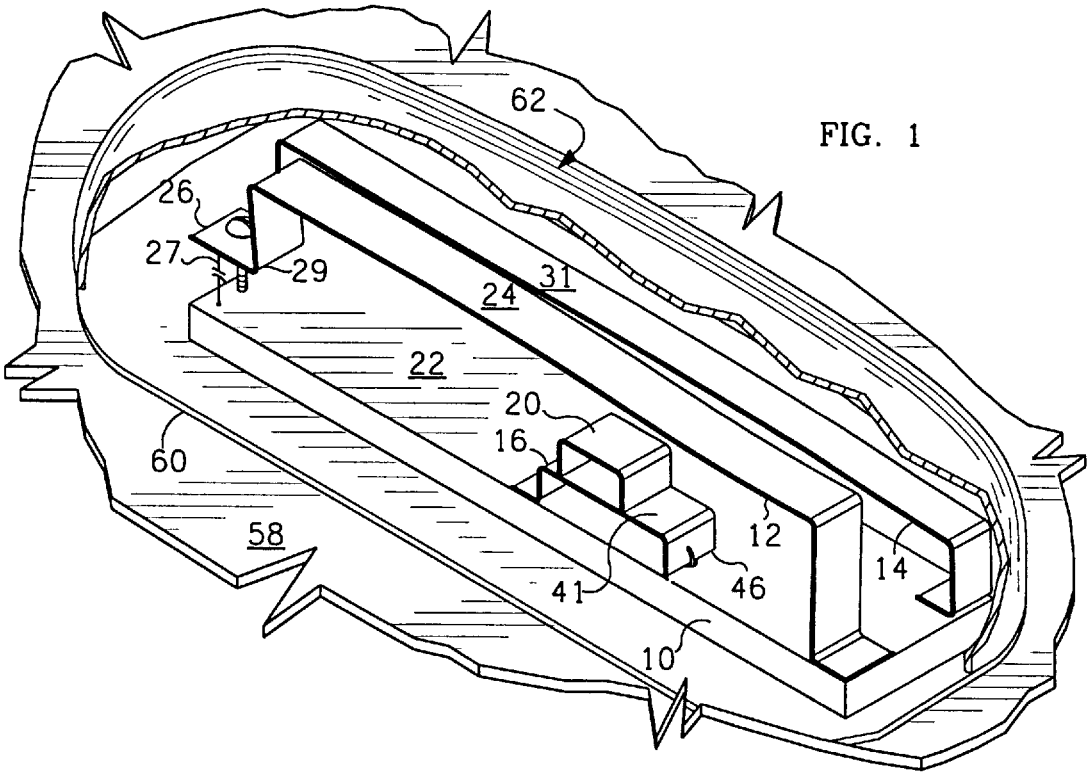
FIG. 1 is a perspective view of one preferred embodiment of an antenna according to the present invention within a radome and supported on a broad conductive platform, with a portion of the radome cut away to better show the antenna.
Figure 2:
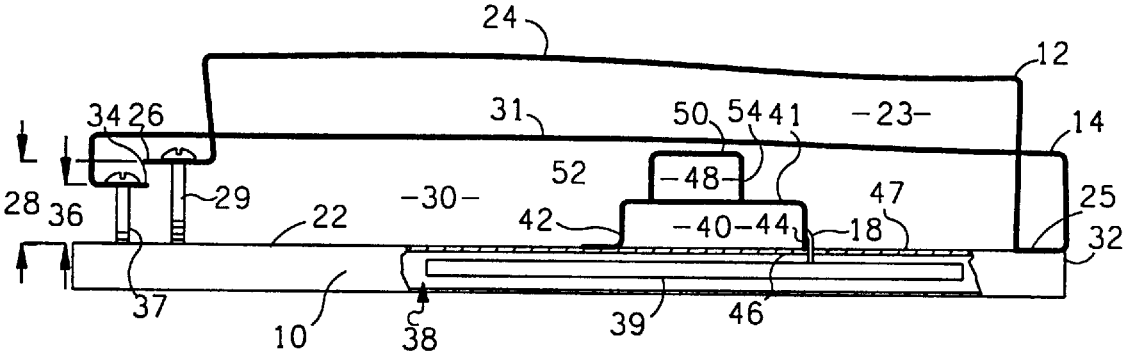
FIG. 2 is a front plan view of the antenna of FIG. 1, with a portion cut away to show a circuit board within a compartment of the ground-plane element.
Figure 3:
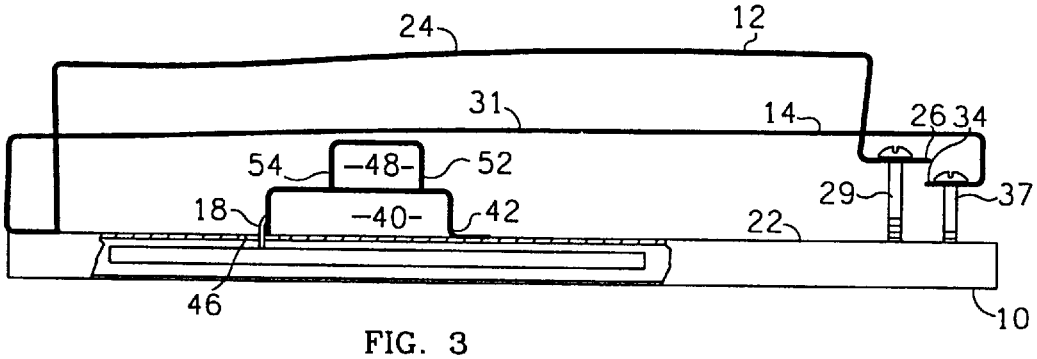
FIG. 3 is a back plan view of the antenna of FIG. 1.

Referring to FIGS. 1, 2 and 3, one preferred embodiment of the antenna of the present invention includes a conductive ground-plane element 10, an elongated ribbon-shaped first radiator element 12 having opposing broad surfaces, an elongated ribbon-shaped second radiator element 14 having opposing broad surfaces, an elongated ribbon-shaped coupling element 16 having opposing broad surfaces, a feed element 18 and an elongated ribbon-shaped third radiator element 20 having opposing broad surfaces. Preferably the radiator elements 12, 14, 20 and the coupling element 16 are made of a highly conductive material, such as aluminum.

The conductive ground-plane element 10 defines a ground plane 22.

The first radiator element 12 is disposed in relation to the ground-plane element 10 with the broad surfaces of a substantial segment 24 of the first radiator element 12 being at least somewhat parallel to the ground plane 22 to define a first vertical loop 23 when the ground plane 22 is horizontally disposed. One end portion 25 of the first radiator element 12 is connected to the ground-plane element 10 and the other end portion 26 of the first radiator element 12 is coupled to the ground-plane element 10 by a terminal capacitance defined by the capacitance across a gap 28 between the ground plane 22 and the other end portion 26 of the first radiator element 12. The other end portion 26 of the first radiator element 12 is supported by a first nonconductive Nylon bolt 29 that is threaded into the ground-plane element 10 such that the capacitance across the gap 28 can be increased or decreased by turning the bolt 29 to raise or lower the other end portion 26. In an alternative embodiment, the first bolt 29 is omitted, and the other end portion 26 of the first radiator element 12 is supported a fixed distance above the ground-plane element 10 by a dielectric spacing element (not shown) that defines the gap 28.

The second radiator element 14 is disposed in relation to the ground-plane element 10 with the broad surfaces of a substantial segment 31 of the second radiator element 14 being at least somewhat parallel to the ground plane 22 to define a second vertical loop 30 when the ground plane 22 is horizontally disposed. One end portion 32 of the second radiator element 14 is connected to the ground-plane element 10 and the other end portion 34 of the second radiator element 14 is coupled to the ground-plane element 10 by a terminal capacitance defined by the capacitance across a gap 36 between the ground plane 22 and the other end portion 34 of the second radiator element 14. The other end portion 34 of the second radiator element 14 is supported by a second nonconductive Nylon bolt 37 that is threaded into the ground-plane element 10 such that the capacitance across the gap 36 can be increased or decreased by turning the bolt 37 to raise or lower the other end portion 34. Once the capacitances across the gap 28 and the gap 36 have been fixed, the tuning does not drift, thereby allowing the installation to be permanent. In an alternative embodiment, the second bolt 37 is omitted, and the other end portion 34 of the second radiator element 14 is supported a fixed distance above the ground-plane element 10 by a dielectric spacing element (not shown) that defines the gap 36.

Resonant conditions occur as a consequence of adjusting the terminal capacitances such that the input impedance of the antenna is purely real.

The substantial segment 24 of the first radiator element 12 is spaced above the ground plane 22 by at least approximately two-and-three-quarters inches (7 cm.) in order to provide a bandwidth in the VHF band of at least 1.4 percent for a VSWR of 5:1 or better, for transmission in the VHF band. It is preferred that such spacing be approximately three-and-one-half inches (8.9 cm.) in order to achieve a bandwidth of at least 1.4 percent for a VSWR of 3:1 or slightly better.

The substantial segment 31 of the second radiator element 14 is spaced above the ground plane 22 by at least approximately one-and-one-half inches (3.8 cm.) in order to provide a bandwidth in the VHF band of approximately one percent for a VSWR of 5:1 or better, which is sufficient for reception in the VHF band, which has a requirement of 0.73 percent.

To achieve the above bandwidths, the coupling element 16 and each of the radiator elements 12, 14, 20 has a width normal to their respective elongation of at least approximately one inch (2.5 cm.).

Moderate increases in the length of the first and second radiator elements 12, 14 does not result in an appreciable increase in bandwidth, unless done in conjunction with raising the height of the respective radiator element. This is attributed to close coupling between the respective radiator element 12, 14, and the ground plane 22, which together in effect form basic transmission lines with characteristic reactances. Increasing bandwidth requires a reduction in the quality factor Q which can be related to the element reactances. Lowering the Q means increasing the characteristic impedance which translates to an increase in height of the radiator element 12, 14 over the ground plane 22.

The first radiator element 12 and the second radiator element 14 are of such dimensions and are so disposed as to be parasitically coupled to each other, to cause the first radiator element 12 to resonate at a first predetermined VHF frequency and to cause the second radiator element 14 to resonate at a second predetermined VHF frequency. The parasitic coupling between the first and second radiating elements 12, 14 is strong thereby creating a tuning dependency which increases as the first and second radiating elements 12, 14 are spaced closer together. Other parameters affecting frequency tuning to a first order are the lengths of the first and second radiating elements 12, 14 and the length of the respective capacitive gaps 28, 36 terminating each of the first and second radiating elements 12, 14. For this reason, the first and second radiating elements 12, 14 are flexible so that each gap 28, 36 can be adjusted for fine tuning. The length of the substantial segment 24 of the first radiator element 12 is approximately one-fifth the wavelength corresponding to the first predetermined VHF frequency and the length of the substantial segment 31 of the second radiator element 14 is approximately one-fifth the wavelength corresponding to the second predetermined VHF frequency.

Each of the first and second radiator elements 12, 14 effectively provides a series L-C circuit, wherein the substantial segment 24, 31 of the element 12, 14 must be of a length to provide sufficient reactance such that adjustment of the capacitance gap 28, 36 at the other end portion 26, 34 of the element 12, 14 can provide resonance at the desired frequency.

The ground-plane element 10 defines a compartment 38 for enclosing the feed terminal 18 and a circuit board 39 containing components of a communication device to which the antenna is connected by the feed terminal 18.

The coupling element 16 is disposed within first vertical loop 23 and in relation to the ground-plane element 10 with the broad surfaces of a substantial segment 41 of the coupling element 16 being at least somewhat parallel to the ground plane 22 to define a vertical coupling loop 40 when the ground plane 22 is horizontally disposed. One end portion 42 of the coupling element 16 is connected to the ground-plane element 10 and the other end portion 44 of the coupling element 16 is connected to the feed terminal 18 which extends through an aperture 46 in the top wall 47 of the ground-plane element 22. The other end portion 44 of the coupling element 16 does not contact the ground-plane element 10.

The third radiator element 20 is disposed on the coupling element 16 with the broad surfaces of a substantial segment 50 of the third radiator element 20 being at least somewhat parallel to the ground plane 22 to define an auxiliary vertical loop 48 when the ground plane 22 is horizontally disposed. The end portions 52, 54 of the third radiator element are connected to the coupling element 16. The third radiator element 20 is of such dimensions and is so disposed as to provide a resonance at a third predetermined UHF frequency.

The coupling element 16 is of such dimensions and is so disposed in relation to the first radiator element 12 and the second radiator element 14 as to cause a signal at the first predetermined frequency to be inductively coupled between the first radiator element 12 and the feed terminal 18 and to cause a signal at the second predetermined frequency to be inductively coupled between the second radiator element 14 and the feed terminal 18. The inductive coupling loop 40 provided by the coupling element 16 excites the first and second radiator elements 12, 14 without physical contact.

The coupling element 16 is also of such dimensions and is so disposed as to cause a signal at the third predetermined frequency to be inductively coupled between the third radiator element 20 and the feed terminal 18.

Nonconductive spacing elements, which may include a damping device or material, such as a block of solid foam (not shown), are disposed about the first radiator element 12, the second radiator element 14, the third radiator element 20 and the coupling element 16 for inhibiting mechanical vibration thereof since such mechanical vibration could eventually result the antenna becoming detuned. In the preferred embodiments, such spacing elements are disposed above and below the radiator elements 12, 14, 20 and the coupling element 16. In FIGS. 1, 2 and 3, such spacing elements are not shown as being disposed about the elements 12, 14, 16, 20 so as not to obstruct the view thereof.

The ground-plane element 10 is supported by a substantially broader electrically conductive platform 58 and disposed substantially parallel to a broad surface of the supporting platform 58 to thereby define a substantially broader effective ground plane for the antenna. The area of such broad surface should be at least approximately forty-eight inches$^2$ (310 cm.$^2$) for adequate impedance matching of the antenna to the communication device. The broad surface of the platform 58 on which the antenna is supported may be the top surface of a vehicle. Although, it is preferred that such surface be relatively smooth, such surface may be corrugated. Different platform surface geometries can influence the tuning of the antenna, but should not affect radiation coverage. A slight variation in tuning occurs when the antenna is mounted inside or on top of a corrugated surface as opposed to mounting the antenna on a flat surface. Some degree of fine tuning may be necessary if the antenna is mounted on different platforms that are vastly different in architecture.

The ground-plane element 10 must be securely mounted to the platform 58. As the size of the effective ground plane increases, sensitivity to other ground mounted structures is diminished. Nearby conducting objects that are not ground mounted tend to re-radiate and shift the antenna resonances. Locating the antenna near the edge of the platform 58, as opposed to being centered on the platform 58, has a marginal effect on tuning. The depth of the ground-plane element 10 in accordance with providing the compartment 38 to house circuit components of the communication device has a marginal effect on tuning, provided that the ground-plane element 10 is adequately grounded. Under any of the conditions noted above, the antenna can be retuned by adjustment of the terminal capacitance gaps 28, 36.

A radome 62 of non-conductive material is mounted on the platform 58 and encloses the antenna elements 12, 14, 20, the coupling element 18 and the ground-plane element 10 in order to protect the antenna from the elements of nature.

A nonconductive plastic sheet 60 covering the bottom of the radome provides DC electrical isolation of the ground-plane element 10 from the conductive platform 58 in order to protect the electrical components of the circuit board 39 from a static discharge from the platform 58. In a alternative embodiment that does not include the plastic sheet 60, the ground-plane element 10 is securely ground mounted to the platform 58.

Even though the ground-plane element 10 is electrically isolated from the platform 58 by the plastic sheet 60, the ground-plane element 10 is capacitively coupled to the platform 58 such that the platform still defines the effective ground plane of the antenna.

Figure 4:
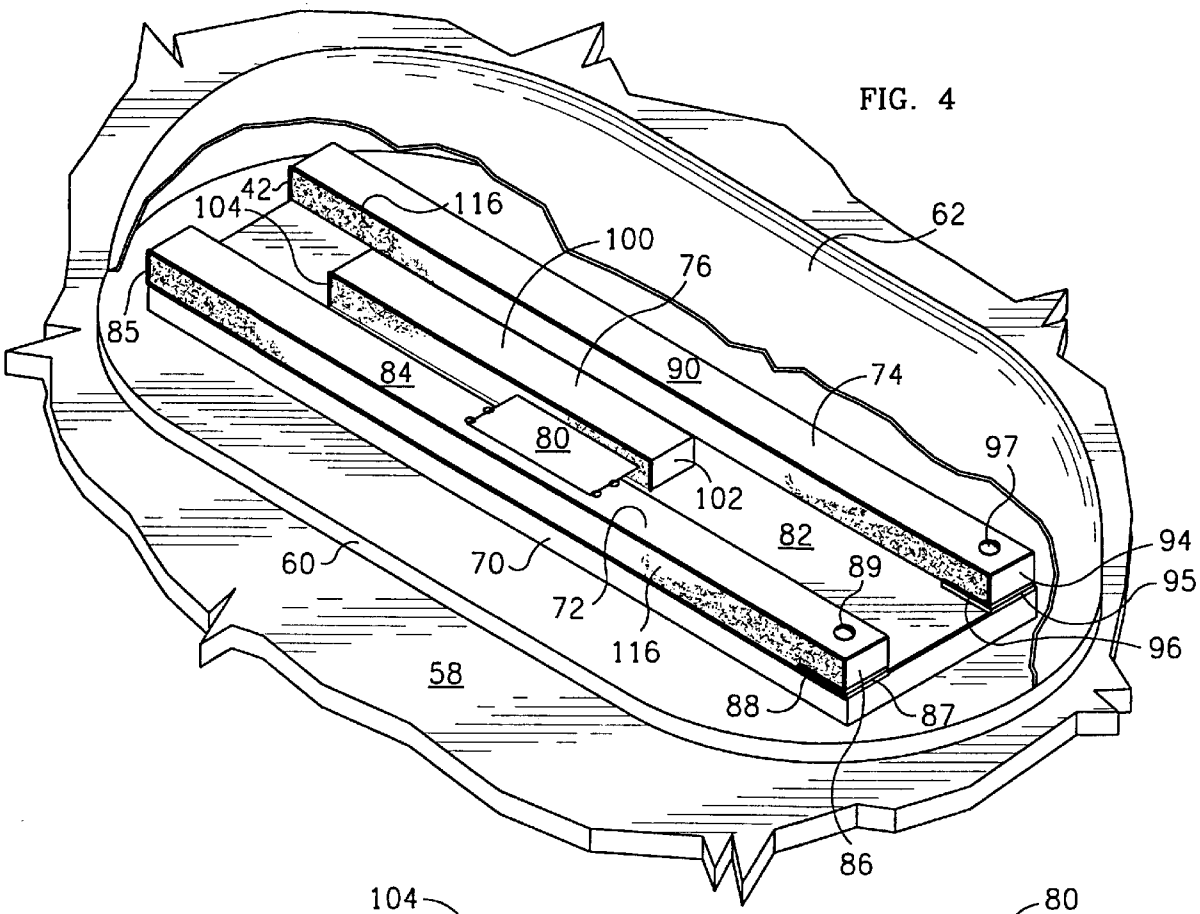
FIG. 4 is a perspective view of another preferred embodiment of an antenna according to the present invention within a radome and supported on a broad conductive platform, with a portion of the radome cut away to better show the antenna.
Figure 5:
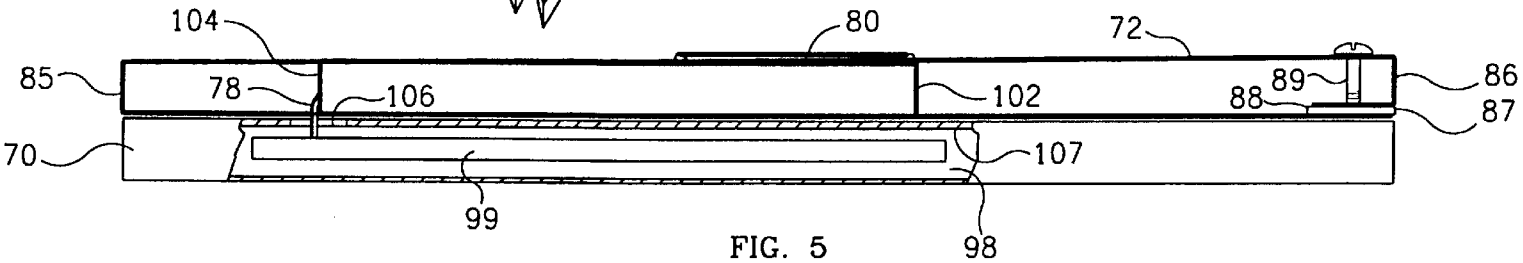
FIG. 5 is a front plan view of the antenna of FIG. 4, with a portion cut away to show a circuit board within a compartment of the ground-plane element.

Referring to FIGS. 4 and 5, another preferred embodiment of the antenna of the present invention includes a conductive ground-plane element 70, an elongated ribbon-shaped first radiator element 72 having opposing broad surfaces, an elongated ribbon-shaped second radiator element 74 having opposing broad surfaces, an elongated ribbon-shaped coupling element 76 having opposing broad surfaces, a feed element 78 and an elongated ribbon-shaped third radiator element 80 having opposing broad surfaces. Preferably the radiator elements 72, 74, 70 and the coupling element 76 are made of a highly conductive material, such as aluminum.

The conductive ground-plane element 70 defines a ground plane 82.

The first radiator element 72 is disposed in relation to the ground-plane element 70 with the broad surfaces of a substantial segment 84 of the first radiator element 72 being at least somewhat parallel to the ground plane 82 to define a first vertical loop when the ground plane 82 is horizontally disposed. One end portion 85 of the first radiator element 72 is connected to the ground-plane element 70 and the other end portion 86 of the first radiator element 72 is coupled to the ground-plane element 70 by a terminal capacitance across a gap 87 broadly defined by a dielectric resilient spacing element 88 between the ground plane 82 and the other end portion 86 of the first radiator element 72. The other end portion 86 of the first radiator element 72 is supported by a first nonconductive Nylon bolt 89 that is threaded into the ground-plane element 70 such that the capacitance across the gap 87 can be increased or decreased by turning the bolt 89 to raise or lower the other end portion 86. In an alternative embodiment, the first bolt 89 is omitted, and the other end portion 86 of the first radiator element 72 is supported a fixed distance above the ground-plane element 10 by a non-resilient dielectric spacing element 88.

The second radiator element 74 is disposed in relation to the ground-plane element 70 with the broad surfaces of a substantial segment 90 of the second radiator element 74 being at least somewhat parallel to the ground plane 72 to define a second vertical loop when the ground plane 82 is horizontally disposed. One end portion 92 of the second radiator element 74 is connected to the ground-plane element 70 and the other end portion 94 of the second radiator element 74 is coupled to the round-plane element 70 by a terminal capacitance across a gap 95 broadly defined by a resilient dielectric spacing element 96 between the ground plane 82 and the other end portion 94 of the second radiator element 74. The other end portion 94 of the second radiator element 74 is supported by a second nonconductive Nylon bolt 97 that is threaded into the ground-plane element 70 such that the capacitance across the gap 95 can be increased or decreased by turning the bolt 97 to raise or lower the other end portion 94. Once the respective terminal capacitances across the gaps 87, 95 at the other end portions 86, 94 of the first and second radiator elements 72, 74 have been fixed, the tuning thereof should not drift, thereby allowing the installation to be permanent. In an alternative embodiment, the second bolt 97 is omitted, and the other end portion 94 of the second radiator element 74 is supported a fixed distance above the ground-plane element 10 by a non-resilient dielectric spacing element 96.

Resonant conditions occur as a consequence of adjusting the terminal capacitances such that the input impedance of the antenna is purely real.

The substantial segment 84 of the first radiator element 72 and the substantial segment 90 of the second radiator element 74 are of approximately the same length and are tuned for different resonant frequencies by adjustment of their terminal capacitances by turning the respective bolts 89 and 97.

For a specified length of the substantial segment 84, 90 of the radiator element 72, 74, the height of the substantial segment 84, 90 of the radiator element 72, 74 above the ground plane 82 must be such as to provide a suitable reactance for resonance. In a preferred embodiment of the antenna shown in FIGS. 4 and 5, the substantial segment 84 of the first radiator element 72 and the substantial segment 90 of the second radiator element 74 are spaced above the ground plane 82 by at approximately one-fiftieth of the wavelength at which the respective radiator element 72, 74 is resonant.

The coupling element 76 and each of the radiator elements 72, 74, 80 has a width normal to their respective elongation of at least approximately one inch (2.5 cm.).

The first radiator element 72 and the second radiator element 74 are so disposed as to be parasitically coupled to each other.

Parameters affecting frequency tuning to a first order are the lengths of the first and second radiating elements 72, 74 and the length and height of the respective capacitive gaps 88, 96 terminating each of the first and second radiating elements 72, 74 . For this reason, the first and second radiating elements 72, 74 are flexible so that each gap 87, 95 can be adjusted for fine tuning. In this embodiment, the length of the substantial segment 84 of the first radiator element 72 is approximately one-fifth the wavelength corresponding to the first predetermined VHF frequency and the length of the substantial segment 90 of the second radiator element 14is approximately one-fifth the wavelength corresponding to the second predetermined VHF frequency.

Each of the first and second radiator elements 72, 74 effectively provides a series L-C circuit, wherein the substantial segment 84, 90 of the element 72, 74 must be of a length to provide sufficient reactance such that adjustment of the capacitance gap 88, 86 at the other end portion 86, 94 of the element 72, 74 can provide resonance at the desired frequency.

The ground-plane element 70 defines a compartment 98 for enclosing the feed terminal 78 and a circuit board 99 containing components of a communication device to which the antenna is connected by the feed terminal 78.

The coupling element 76 is disposed in relation to the ground-plane element 70 with the broad surfaces of a substantial segment 100 of the coupling element 76 being at least somewhat parallel to the ground plane 82 to define a vertical coupling loop when the ground plane 82 is horizontally disposed. The coupling element 76 is disposed between the first radiator element 72 and the second radiator element 74 with the broad surfaces of the substantial segment 84 of first radiator element 72 and the substantial segment 90 of the second radiator element 74 being at least somewhat disposed in approximately the same plane as the broad surfaces of the substantial segment 100 of the coupling element 76. One end portion 102 of the coupling element 76 is connected to the ground-plane element 70 and the other end portion 104 of the coupling element 76 is connected to the feed terminal 78 which extends through an aperture 106 in the top wall 107 of the ground-plane element 82. The other end portion 104 of the coupling element 76 does not contact the ground-plane element 70.

The third radiator element 80 contacts the first radiator element 72 and the broad surfaces of the third radiator element 80 extend from the first radiator element 72 toward the coupling element 76 with the broad surfaces of the third radiator element 80 being at least somewhat disposed in approximately the same plane as the broad surfaces of the substantial segment 84 of first radiator element and the substantial segment 100 of the coupling element 76. The third radiator element 80 is of such dimensions and is so disposed as to provide a resonance at a third predetermined UHF frequency.

The coupling element 76 is of such dimensions and is so disposed in relation to the first radiator element 72 and the second radiator element 74 as to cause a signal at the first predetermined frequency to be inductively coupled between the first radiator element 72 and the feed terminal 78 and to cause a signal at the second predetermined frequency to be inductively coupled between the second radiator element 74 and the feed terminal 78. The inductive coupling loop provided by the coupling element 76 excites the first and second radiator elements 72, 74 without physical contact.

The coupling element 76 is also of such dimensions and is so disposed as to cause a signal at the third predetermined frequency to be inductively coupled between the third radiator element 80 and the feed terminal 78.

Non-conductive spacing elements, which may include a damping device or material 116, such as a block of solid foam, are disposed about the first radiator element 72, the second radiator element 74, the third radiator element 80 and the coupling element 76 for inhibiting mechanical vibration thereof since such mechanical vibration could eventually result in the antenna becoming detuned. In the preferred embodiments, such spacing elements 116 are disposed above and below the radiator elements 72, 74, 80 and the coupling element 80. In FIG. 4, the spacing elements 116 are not shown as being disposed above the elements 72, 74, 76, 80 so as not to obstruct the view thereof The ground-plane element 70 is supported by a substantially broader electrically conductive platform 58 and the antenna of FIGS. 4 and 5 is disposed within a radome 62 of non-conductive material in substantially the same manner as in the preferred embodiment of the antenna described above in relation to FIGS. 1, 2 and 3.

The size of the antenna of the present invention is such that the antenna is effectively omni-directional; and the antenna is used for transmission and reception of communication signals that are sent to and from an orbiting communications satellite.

The preferred embodiment of the antenna of FIGS. 4 and 5 may be constructed with a lower profile than that of preferred embodiment of the antenna of FIGS. 1, 2 and 3. The antennas of both embodiments can be constructed with such a low profile that they are suitable for use on a motor vehicle. Batteries for a portable antenna according to the present invention may be disposed in the compartment 38, 98 of the respective ground plane element 10, 70 or in a separate compartment (not shown) adjacent the end of the ground plane element 10, 70.

In other alternative embodiments (not shown), the antenna may include more than two radiator elements that resonate in the same frequency band.

The antenna of the present invention may made as a broad band antenna by designing the radiator elements so that there is a broad band between the fundamental resonant frequencies of the radiator elements.

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as exemplifications of the preferred embodiments described herein. Other variations are possible and the scope of the present invention should be determined not by the embodiments described herein but rather by the claims and their legal equivalents.

We claim:

1. A multi-band antenna, comprising a ground-plane element defining a ground plane;

an elongated ribbon-shaped first radiator element having opposing broad surfaces and disposed on the ground-plane element with the broad surfaces of a substantial segment of the first radiator element being at least somewhat parallel to the ground plane to define a first vertical loop when the ground plane is horizontally disposed;

a second radiator element;

an elongated ribbon-shaped coupling element having opposing broad surfaces and disposed on the ground-plane element with the broad surfaces of a substantial segment of the coupling element being at least somewhat parallel to the ground plane to define a vertical coupling loop when the ground plane is horizontally disposed, and with a portion of the coupling element being connected to a feed terminal;

wherein the first radiator element, the second radiator element and the coupling element are of such dimensions and are so disposed in relation to each other as to cause the first radiator element to resonate at a first predetermined frequency, to cause the second radiator element to resonate at a second predetermined frequency, to cause a signal at the first predetermined frequency to be inductively coupled between the first radiator element and the feed terminal and to cause a signal at the second predetermined frequency to be inductively coupled between the second radiator element and the feed terminal.

2. An antenna according to claim 1, wherein the second radiator element is elongated and ribbon-shaped with opposing broad surfaces and disposed on the ground-plane element with the broad surfaces of a substantial segment of the second radiator element being at least somewhat parallel to the ground plane to define a second vertical loop when the ground plane is horizontally disposed.

3. An antenna according to claim 2, further comprising a third radiator element of such dimensions and so disposed in relation to the coupling element as to resonate at a third predetermined frequency and to cause a signal at the third predetermined frequency to be inductively coupled between the third radiator element and the feed terminal.

4. An antenna according to claim 3, wherein the first and second predetermined frequencies are in the VHF band and the third predetermined frequency is in the UHF band.

5. An antenna according to claim 2, wherein the first radiator element and the second radiator element are of such dimensions and are so disposed as to be parasitically coupled to each other.

6. An antenna according to claim 5, wherein the coupling element is disposed within the first vertical loop.

7. An antenna according to claim 6, further comprising an elongated ribbon-shaped third radiator element having opposing broad surfaces disposed on the substantial segment of the coupling element with the broad surfaces of a substantial segment of the third radiator element being at least somewhat parallel to the ground plane to define an auxiliary vertical loop when the ground plane is horizontally disposed;

wherein the third radiator element is of such dimensions and is so disposed on the coupling element as to resonate at a third predetermined frequency and to cause a signal at the third predetermined frequency to be inductively coupled between the third radiator element and the feed terminal.

8. An antenna according to claim 7, wherein the first and second predetermined frequencies are in the VHF band and the third predetermined frequency is in the UHF band.

9. An antenna according to claim 2, wherein the coupling element is disposed between the first radiator element and the second radiator element with the broad surfaces of the substantial segments of first radiator element and the second radiator element being at least somewhat disposed in approximately the same plane as the broad surfaces of the substantial segment of the coupling element.

10. An antenna according to claim 9, further comprising a third radiator element contacting the first radiator element and having opposing broad surfaces extending from the first radiator element toward the coupling element with the broad surfaces of the third radiator element being at least somewhat disposed in approximately the same plane as the broad surfaces of the substantial segments of first radiator element and the coupling element;

wherein the third radiator element is of such dimensions and is so disposed in relation to the coupling element as to resonate at a third predetermined frequency and to cause a signal at the third predetermined frequency to be inductively coupled between the third radiator element and the feed terminal.

11. An antenna according to claim 10, wherein the first and second predetermined frequencies are in the VHF band and the third predetermined frequency is in the UHF band.

12. An antenna according to claim 1, wherein the second radiator element is elongated and ribbon-shaped with opposing broad surfaces and is disposed on the coupling element with the broad surfaces of a substantial segment of the second radiator element being at least somewhat parallel to the ground plane to define an auxiliary vertical loop when the ground plane is horizontally disposed.

13. An antenna according to claim 12, wherein the first predetermined frequency is in the VHF band and the second predetermined frequency is in the UHF band.

14. An antenna according to claim 1, wherein the coupling element is disposed adjacent the first radiator element with the broad surfaces of the substantial segment of the first radiator element being at least somewhat disposed in approximately the same plane as the broad surfaces of the substantial segment of the coupling element; and wherein the second radiator element contacts the first radiator element and has opposing broad surfaces extending from the first radiator element toward the coupling element with the broad surfaces of the second radiator element being at least somewhat disposed in approximately the same plane as the broad surfaces of the substantial segment of the first radiator element and the coupling element.

15. An antenna according to claim 14, wherein the first predetermined frequency in the VHF band and the second predetermined frequency is in the UHF band.

16. An antenna according to claim 1, wherein the ground-plane element is supported by a substantially broader electrically conductive platform and disposed substantially parallel to a broad surface of said platform to thereby define an effective ground plane for the antenna.

17. An antenna according to claim 16, in combination with a nonconductive material for electrically isolating the ground-plane element from the conductive platform.

18. An antenna according to claim 1, in combination with a radome of non-conductive material enclosing the radiator elements, the coupling element and the ground-plane element, wherein the ground-plane element is supported by a substantially broader electrically conductive platform and disposed substantially parallel to a broad surface of said platform to thereby define an effective ground plane for the antenna; and wherein the nonconductive material electrically isolates the ground-plane element from the conductive platform.

19. An antenna according to claim 1, wherein the ground-plane element defines a compartment for enclosing circuit components of a given communication device connected to the feed terminal.

20. An antenna according to claim 19, in combination with said enclosed circuit components.

21. An antenna according to claim 1, further comprising means for inhibiting mechanical vibration of the radiator elements and the coupling element.

22. An antenna according to claim 1, wherein one end portion of the first radiator element is connected to the ground-plane element and another end portion of the first radiator element is capacitively coupled to the ground-plane element; and wherein another portion of the coupling element is connected to the ground-plane element.

23. An antenna according to claim 22, wherein the second radiator element is elongated and ribbon-shaped with opposing broad surfaces and disposed on the ground-plane element with the broad surfaces of a substantial segment of the second radiator element being at least somewhat parallel to the ground plane to define a second vertical loop when the ground plane is horizontally disposed, with one end portion of the second radiator element being connected to the ground-plane element and with another end portion of the second radiator element being capacitively coupled to the ground-plane element.

24. An antenna according to claim 23, further comprising an elongated ribbon-shaped third radiator element having opposing broad surfaces and disposed on the substantial segment of the coupling element with the broad surfaces of a substantial segment of the third radiator element being at least somewhat parallel to the ground plane to define an auxiliary vertical loop when the ground plane is horizontally disposed, and with each end of the third radiator element being connected to the coupling element;

wherein the third radiator element is of such dimensions and is so disposed in relation to the coupling element as to resonate at a third predetermined frequency and to cause a signal at the third predetermined frequency to be inductively coupled between the third radiator element and the feed terminal.

25. An antenna according to claim 23, wherein the coupling element is disposed between the first radiator element and the second radiator element with the broad surfaces of the substantial segments of the first radiator element and the second radiator element being at least somewhat disposed in approximately the same plane as the broad surfaces of the substantial segment of the coupling element; the antenna further comprising a third radiator element contacting the first radiator element and having opposing broad surfaces extending from the first radiator element toward the coupling element with the broad surfaces of the third radiator element being at least somewhat disposed in approximately the same plane as the broad surfaces of the substantial segments of the first radiator element and the coupling element;

wherein the third radiator element is of such dimensions and is so disposed in relation to the coupling element as to resonate at a third predetermined frequency and to cause a signal at the third predetermined frequency to be inductively coupled between the third radiator element and the feed terminal.

26. An antenna according to claim 22, wherein the other end portion of the first radiator element is supported above the ground-plane element by a nonconductive bolt that is threaded into the ground-plane element such that a capacitance across a gap between the other portion of the first radiator element and the ground plane can be increased or decreased by turning the bolt to raise or lower the other portion of the first radiator element.

27. An antenna according to claim 26, further comprising means for inhibiting mechanical vibration of the radiator elements and the coupling element.

28. An antenna, comprising a conductive ground-plane element defining a ground plane;

an elongated ribbon shaped coupling element having broad opposing surfaces and disposed in relation to the ground-plane element to define a vertical coupling loop when the ground plane is horizontally disposed, with the broad surfaces of a substantial segment of the coupling element being at least somewhat parallel to the ground plane, and with one end portion of the coupling element being connected to a feed terminal; and an elongated ribbon-shaped radiator element having broad opposing surfaces and disposed on the substantial segment of the coupling element to define an auxiliary vertical loop when the ground plane is horizontally disposed, with the broad surfaces of a substantial segment of the radiator element being at least somewhat parallel to the ground plane;

wherein the radiator element is of such dimensions and is so disposed as to resonate at a predetermined frequency; and wherein the coupling element is of such dimensions and is so disposed as to cause a signal at the predetermined frequency to be inductively coupled between the radiator element and the feed terminal;

wherein another end portion of the coupling element is connected to the ground-plane element and each end of the radiator element is connected to the coupling element.

29. An antenna according to claim 28, wherein the predetermined frequency is in the UHF band.

30. An antenna according to claim 28, wherein the ground-plane element is disposed on and substantially parallel to a substantially broader electrically conductive surface to thereby define an effective ground plane for the antenna.

31. An antenna according to claim 30, in combination with a nonconductive material for electrically isolating the ground-plane element from the conductive surface.

32. An antenna according to claim 28, in combination with a radome of non-conductive material enclosing the radiator element, the coupling element and the ground-plane element, wherein the ground-plane element is supported by a substantially broader electrically conductive platform and disposed substantially parallel to a broad surface of said platform to thereby define an effective ground plane for the antenna; and wherein the nonconductive material electrically isolates the ground-plane element from the conductive platform.

33. An antenna according to claim 28, wherein the ground-plane element defines a compartment for enclosing circuit components of a given communication device connected to the feed terminal.

* * * * *